US009152067B2

(12) United States Patent
Chiba et al.

(10) Patent No.: US 9,152,067 B2
(45) Date of Patent: Oct. 6, 2015

(54) TONER, DEVELOPMENT AGENT, AND IMAGE FORMING APPARATUS

(71) Applicants: Susumu Chiba, Shizuoka (JP); Hiroshi Yamashita, Shizuoka (JP); Daisuke Asahina, Shizuoka (JP); Tsuyoshi Sugimoto, Shizuoka (JP); Taichi Nemoto, Shizuoka (JP); Satoyuki Sekiguchi, Shizuoka (JP)

(72) Inventors: Susumu Chiba, Shizuoka (JP); Hiroshi Yamashita, Shizuoka (JP); Daisuke Asahina, Shizuoka (JP); Tsuyoshi Sugimoto, Shizuoka (JP); Taichi Nemoto, Shizuoka (JP); Satoyuki Sekiguchi, Shizuoka (JP)

(73) Assignee: Ricoh Company, Ltd., Tokyo (JP)

( * ) Notice: Subject to any disclaimer, the term of this patent is extended or adjusted under 35 U.S.C. 154(b) by 16 days.

(21) Appl. No.: 13/932,556

(22) Filed: Jul. 1, 2013

(65) Prior Publication Data

US 2014/0023965 A1 Jan. 23, 2014

(30) Foreign Application Priority Data

Jul. 23, 2012 (JP) ..... 2012-162524
Mar. 12, 2013 (JP) ..... 2013-048596

(51) Int. Cl.
*G03G 9/087* (2006.01)

(52) U.S. Cl.
CPC ..... *G03G 9/08755* (2013.01); *G03G 9/08795* (2013.01); *G03G 9/08797* (2013.01)

(58) Field of Classification Search
CPC ..... G03G 9/08755; G03G 9/08797; G03G 9/08795
USPC ..... 430/109.4
See application file for complete search history.

(56) References Cited

U.S. PATENT DOCUMENTS

| | | | | |
|---|---|---|---|---|
| 2007/0015077 | A1 | 1/2007 | Yamashita et al. | |
| 2007/0105033 | A1* | 5/2007 | Moribe et al. | 430/109.3 |
| 2007/0219313 | A1* | 9/2007 | Mizuhata et al. | 524/599 |
| 2008/0227002 | A1 | 9/2008 | Moriya et al. | |
| 2009/0003885 | A1 | 1/2009 | Sabu et al. | |
| 2009/0142687 | A1* | 6/2009 | Ariyoshi et al. | 430/109.4 |
| 2011/0065036 | A1 | 3/2011 | Inoue et al. | |
| 2011/0129775 | A1 | 6/2011 | Sawada et al. | |
| 2012/0065357 | A1 | 3/2012 | Yamauchi et al. | |
| 2013/0059247 | A1 | 3/2013 | Sugimoto et al. | |

FOREIGN PATENT DOCUMENTS

| | | |
|---|---|---|
| JP | 4-179967 | 6/1992 |
| JP | 6-289644 | 10/1994 |
| JP | 9-319144 | 12/1997 |
| JP | 2002-284881 | 10/2002 |
| JP | 2006-091278 | 4/2006 |
| JP | 2006-285150 | 10/2006 |
| JP | 2008-262179 | 10/2008 |
| JP | 2010-014757 | 1/2010 |
| JP | 2011-149999 | 8/2011 |

OTHER PUBLICATIONS

Borsenberger, Paul M. et al. Organic Photoreceptors for Imaging Systems. New York: Marcel-Dekker, Inc. (1993) pp. 6-17.*
Diamond, Arthur S & David Weiss (eds.) Handbook of Imaging Materials, 2nd ed. New York: Marcel-Dekker, Inc. (2002) pp. 145-164.*

* cited by examiner

*Primary Examiner* — Christopher Rodee
(74) *Attorney, Agent, or Firm* — Oblon, McClelland, Maier & Neustadt, L.L.P.

(57) ABSTRACT

Toner contains a binder resin and a colorant, wherein the binder resin contains a resin having a polyhydroxy carboxylic acid skeleton, wherein the toner has a half effusion temperature of from 80° C. to 120° C. as measured by a temperature rising method using a flow tester.

13 Claims, 1 Drawing Sheet

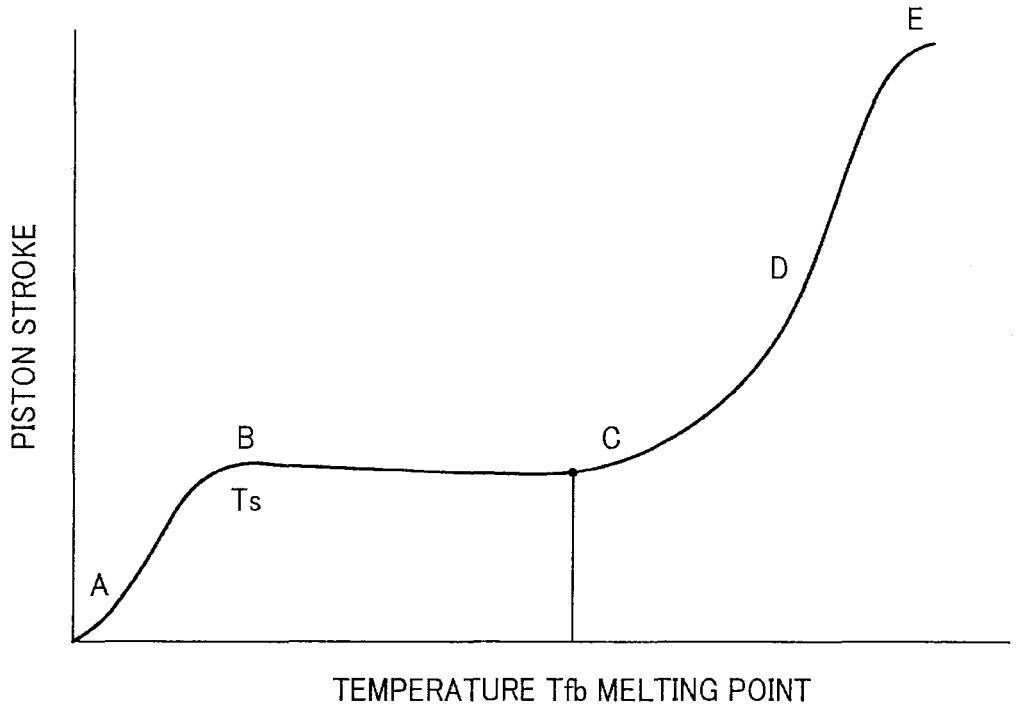
E
D
PISTON STROKE
B
C
Ts
A
TEMPERATURE Tfb MELTING POINT

TONER, DEVELOPMENT AGENT, AND IMAGE FORMING APPARATUS

CROSS-REFERENCE TO RELATED APPLICATIONS

This patent application is based on and claims priority pursuant to 35 U.S.C. §119 to Japanese Patent Application Nos. 2012-162524 and 2013-048596, filed on Jul. 23, 2012 and Mar. 12, 2013, respectively, in the Japan Patent Office, the entire disclosures of which are hereby incorporated by reference herein.

BACKGROUND

1. Technical Field

The present invention relates to toner, a development agent, and an image forming apparatus.

2. Background Art

In electrophotography, electrostatic images (latent images) are formed on an image bearing member (typically a photoreceptor) and developed with toner to form visible toner images. The thus-formed toner image is transferred onto a transfer medium, typically paper, and thereafter fixed thereon by heating, etc.

Such toner contains a binder resin formed of, for example, a thermal plastic resin derived from petroleum such as a styrene-acrylic resin or a polyester resin. However, due to environmental concerns of late, using a biodegradable resin derived from biomass made from a recyclable resource starts to gain attention to reduce the burden on the environment at the time of disposal.

JP-H04-179967-A discloses using a microbial aliphatic polyester as such a biodegradable resin. However, if the microbial aliphatic polyester is used as a resin for toner, the softening temperature thereof becomes high because of its high crystallinity. As a consequence, the fixing temperature of the toner is inevitably high, which is disadvantageous in terms of energy-saving.

JP-2597452-B1 (JP-H06-289644-A) discloses a method of lowering the softening point of toner containing a biodegradable resin by adding a plant wax in a large amount to lower the fixing temperature of the toner. However, the toner easily agglomerates due to the wax component contained therein. Accordingly, the productivity suffers and the fluidity of the toner deteriorates, which has a negative impact on the toner transferability in a development device.

JP-2006-91278-A and JP-2006-285150-A disclose using a binder resin containing two kinds of resins having different softening points and a biodegradable resin (polylactic acid). The resin having a lower softening point serves to link the resin having a higher softening point and the biodegradable resin, so that the biodegradable resin is uniformly dispersed in the binder resin to obtain toner having a good low temperature fixability and fixing stability.

However, if the blending ratio of the biodegradable resin is designed to be high, the dispersion of the biodegradable resin tends to deteriorate. This leads to degradation of the developability due to variation of the charging power, which has an adverse impact on the durability. For this reason, the blending ratio of the biodegradable resin is unavoidingly extremely low, i.e., around 20% by weight, which is not sufficient to lessen the burden on the environment.

In addition, such toner is prepared by melt-kneading a binder resin and a blending agent such as a colorant, a charge control agent, and an offset resistance agent followed by pulverization and classification of the thus-obtained toner composition. However, the toner composition is required to be pulverizable and classifiable by an economically-affordable device. Moreover, the melt-kneaded toner composition must be sufficiently brittle. Accordingly, the selection of the toner material is limited, which inhibits furthermore improvement of the low temperature fixability.

Furthermore, the toner composition is pulverized to form toner particles, resulting in production of toner having a wide particle size distribution although toner having a sharp particle size distribution is suitable to obtain photocopy images having good definition and gradation. For this reason, fine particles having a particle diameter of 5 μm or less and coarse particles having a particle diameter of 20 μm or more are removed by classification, which invites an extremely low yield.

In addition, the pulverization method is disadvantageous in terms of uniform dispersion of a blending agent such as a colorant and a charge control agent in a thermoplastic resin. Unless such a blending agent is uniformly dispersed, the fluidity, the developability, the durability, and the image quality are adversely affected.

JP-3344214-B1 (JP-H09-319144-A) and JP-3455523-B1 (JP-2002-284881-A) disclose methods of granulating toner particles by dispersing a resin solution in which a binder resin is preliminarily dissolved in an organic solvent in an aqueous medium although no biodegradable resin is used. Such methods obviate the need for classification to obtain uniform particles.

However, if polylactic acid, which is made from plant resources, widely used, and available without difficulty is polymerized by using a single monomer, the crystallinity is so high that the solubility of the polylactic acid is extremely low. Therefore, using the method mentioned above including granulation in an aqueous medium after dissolution in an organic solvent is not suitable for such a polylactic acid.

A polylactic acid can be dissolved in an organic solvent more easily by using a monomer mixture of L-form and D-form, which are optical isomers of the polylactic acid instead of a simple monomer of L-form or D-form while changing the ratio of L-form/D-form to lower the crystallinity.

However, considering that it is difficult to control the molecular weight of polylactic acid and the molecular chain via ester linkage is only carbon atom (N=1), toner having satisfactory properties is not easily obtained by polylactic acid only.

One thinkable way to solve this issue is using a mixture of a polylactic acid and a second resin other than a polylactic acid to secure properties required for toner. However, even if the issues about the crystallinity and the solubility in an organic solvent are clear, it is extremely difficult to manufacture toner having satisfactory properties by using polylactic acid in combination with other resins because the compatibility and dispersability thereof with widely-used products in toner such as polyester resins and styrene and acrylic copolymers are extremely poor.

Among efforts to solve this issue, JP-2008-262179-A discloses using a block polymer having a polylactic acid unit and a polyester unit having no polylactic acid to improve the compatibility, thereby unifying the resin composition in toner, which leads to stable image output.

Moreover, JP-2010-14757-A discloses a method of forming a film on resin particles prepared by reaction of a polylactic acid and a material obtained by reacting the polylactic acid with an elongating agent with other resin particulates to obtain polylactic acid toner having excellent thermal properties, high temperature stability, and transparency.

Although this method is successful about the high temperature stability and the transparency, toner using polylactic acid generally has a high melt-viscosity, which makes it difficult to manufacture toner having a low fixing temperature. This is not preferable in terms of energy-saving.

It is possible to lower the melt viscosity of polylactic acid by decreasing the molecular weight thereof. However, by simply decreasing the molecular weight of polylactic acid, residual monomers and oligomers increase, thereby reducing hydrolysis resistance of polylactic acid, which inhibits demonstration of sufficient storage stability of toner.

JP-2011-149999-A discloses a method of lowering the fixing temperature by adding an aliphatic acid amide as a fixing helping agent.

In this method, in granulation of toner particles by dispersing an oil phase in which toner materials are dissolved or dispersed in an organic solvent in an aqueous medium, the aliphatic acid amide is melted in the organic solvent or an aqueous medium, which makes it difficult to obtain toner having a small particle diameter with a sharp particle size distribution.

In addition, widely-used polylactic acid is known to be not or little compatible with other organic materials so that when polylactic acid is used in combination with a fixing helping agent, the melt-viscosity of the toner is not sufficiently lowered by using the fixing helping agent. Also, since it is not easy to control arrangement of the fixing helping agent in toner particles and resultantly the fixing helping agent is exposed to the surfaces of the toner particles, agglomeration tends to occur in a development device due to mechanical stress.

As described above, it is not easy to use a plant resin as the main component of the binder resin of toner and the blend ratio of a plant resin is limited in the method in which part of the binder resin is replaced with the plant resin. Therefore, a technology to blend a plant resin in a higher ratio without a negative impact on the properties of the binder resin of toner is demanded.

SUMMARY

The present invention provides toner that contains a binder resin and a colorant, wherein the binder resin contains a resin having a polyhydroxy carboxylic acid skeleton, wherein the toner has a half effusion temperature of from 80° C. to 120° C. as measured by a temperature rising method using a flow tester.

BRIEF DESCRIPTION OF THE DRAWINGS

Various other objects, features and attendant advantages of the present invention will be more fully appreciated as the same become better understood from the detailed description when considered in connection with the accompanying drawings, in which like reference characters designate like corresponding parts throughout and wherein FIGURE is a diagram illustrating a graph of a flow curve of an example of toner of the present disclosure as measured by an elevated flow tester.

DETAILED DESCRIPTION

The present invention is described in detail with reference to accompanying drawings.

The toner of the present disclosure contains a resin having a polyhydroxycarbonic acid skeleton and has a half effusion temperature of from 80° C. to 120° C. as measured by a temperature rising method using an elevated flow tester.

As the half effusion temperature is from 80° C. to 120° C., it is possible to strike a balance between hot offset resistance and low temperature fixability by using a material derived from plants.

When the half effusion temperature of toner is too low, the high temperature stability of toner tends to deteriorate. When the half effusion temperature is too high, the low temperature fixability may deteriorate.

Measuring of Half Effusion Temperature in Temperature Rising Method

In the present disclosure, the half effusion temperature is measured by an elevated flow tester (CFT 500 type, manufactured by Shimadzu Corporation) based on the method described in JIS K72101. While heating a sample of 1 $cm^3$ at a temperature rising speed of 3° C./min.

A load of 30 $kg/cm^2$ is applied to the sample by a plunger to extrude a nozzle having a diameter of 0.5 mm and a length of 1 mm to draw a curve of a plunger descending amount and temperature.

The flow curve by this flow tester is data as illustrated in FIGURE and various temperatures are read therefrom as follows. In FIGURE, A is a measuring starting temperature, B represents the softening temperature Ts, C is an effusion starting temperature, D represents the half effusion temperature, and E represents the measuring completion temperature.

Binder Resin

Any binder resin that contains a resin having a polyhydroxycarbonic acid skeleton and has a half effusion temperature of from 80° C. to 120° C. is usable in the present disclosure.

A crystalline resin has a crystal transition at the melting point and simultaneously the melt-viscosity of the crystalline resin rapidly lowers from the solid state so that it demonstrates a fixing power on a recording medium such as paper. By contrast, in a case of a non-crystalline resin, the melt-viscosity starts to gradually lower from the glass transition temperature Tg. Consequently, there is generally a temperature difference of about several tens degrees between the glass transition temperature and temperatures, for example, the half effusion temperature at which the melt-viscosity lowers sufficiently to demonstrate the fixing power.

Therefore, to obtain toner formed of only non-crystalline resins which demonstrate a low temperature fixability, the half effusion temperature is lowered by lowering Tg or decreasing the molecular weight. However, this has a negative impact on the high temperature stability and hot offset resistance.

To solve this problem, a crystalline resin and a non-crystalline resin are combined to conduct low temperature fixing by a sharp drop of the melt viscosity without an adverse impact on the high temperature stability and the hot offset resistance.

Therefore, the binder resin for use in the present disclosure contains a first binder resin and optionally a second binder resin, which have polyhydroxycarbonic acid skeleton structures.

First Binder Resin

The first binder resin is the main component of the binder resin and has a polyhydroxy skeleton in the main chain. A specific example thereof is a biodegradable resin that contains repeating units having structures of polycondensed lactic acid, hydroxyalkyl carboxylic acid, etc.

The biodegradable resin has an ester group accounting for a high ratio in the main chain.

Also, it has a short alkyl chain in its branched chain. In comparison with a typical polyester resin, which has an aromatic chain as the main chain, the biodegradable resin contains an ester group accounting for a high ratio per molecular weight and has high transparency in non-crystalline state. Furthermore, although it has only a little number of functional groups such as an organic acid and a hydroxyl group, for example, carboxylic acid, the biodegradable resin has high affinity with various colorants.

The first binder resin is preferably non-crystalline. Such a non-crystalline resin can be obtained by using a racemic form in which L-form and D-form monomers are used in a suitable combination as the monomer.

For example, when using a lactide, it is possible to separately use mixtures of L-lactide and D-lactide but a non-crystalline resin can be obtained by ring-opening polymerization of a meso-lactide or using a mixture of a meso lactide and one of D-lactide and L lactide.

The biodegradable resin preferably has the following optical purity accounting for 80% or less in monomer composition conversion and, more preferably, 60% or less. Within this range, solvent solubility and transparency of the resin are improved. Optical purity X (%)=|X(L-form)−X(D-form)|, where X(L-form) represents an L-form ratio (mol %) in optically active monomer conversion and, X(D-form), an D-form ratio (mol %).

The polyhydroxycarboxylic skeleton is formed by (co) polymerizing a hydroxyl carboxylic acid using a direct dehydration condensation method, a ring opening polymerization method of a corresponding cyclic ester, or a synthesis method using reaction of enzyme such as lipase.

Cyclic esters of aliphatic hydroxycarboxylic acids and hydroxy carboxylic acids can be used as the monomer to form a polyhydroxy carboxylic acid.

In light of the transparency and thermal properties of toner, aliphatic hydroxy carboxylic acids are preferable. Hydroxy carboxylic acids having 2 to 6 carbon atoms such as lactic acid, glycolic acid, and 3-hydroxyl butyrate are more preferable. Among these, lactic acid is particularly preferable.

In addition, in terms of increasing the molecular weight of a hydroxy carboxylic acid to be polymerized, it is preferable to ring-open a cyclic ester In the hydroxy carboxylic acid skeleton of a resin obtained by ring-polymerization, a hydroxy carboxylic acid that constitutes a cyclic ester is polymerized.

For example, in the polyhydroxy carboxylic acid skeleton of a resin obtained by using a lactide, lactic acid is polymerized The non-crystalline biodegradable resin is available from the market. A specific example thereof is polylactic acid (VYLOECOL® BE-410, manufactured by Tosoh Corporation).

The weight average molecular weight (Mw) of the first binder resin is preferably from 7,000 to 70,000, more preferably from 10,000 to 40,000, and most preferably from 15,000 to 35,000 in the molecular weight distribution of the portion soluble in tetrahydrofuran (THF) as measured by gel permeation chromatography (GPC) in light of high temperature stability and low temperature fixability.

The glass transition temperature of the first binder resin is preferably from 40° C. to 70° C. and more preferably from 45° C. to 65° C. When the glass transition temperature is too low, the high temperature stability may deteriorate. When the glass transition temperature is too high, the low temperature fixability may deteriorate.

Second Binder Resin

The second binder resin contains a non-crystalline unit and a crystalline unit and has affinity with the first binder resin. In addition, it lowers the melting temperature of toner. Furthermore, in a case in which a fixing helping agent, which is described later is optionally contained in toner, the second binder resin prevents the phase separation of the first binder resin and the fixing helping agent.

The non-crystalline unit of the second binder resin contains a polyhydroxylic acid skeleton and is biodegradable.

As the non-crystalline unit of the second binder resin, the same units as in the first binder resin are usable.

The second binder resin is capable of lowering the melting point of toner without decreasing the molecular weight of the unit having a polyhydroxylic acid skeleton in its main chain because the second binder resin contains a crystalline unit. Although it is possible to use any unit having crystallinity as the crystalline unit of the second binder resin, a crystalline polyester resin is preferable in terms of sharp melt during fixing and smoothness of the image surface.

The crystalline polyester preferably has a structure represented by —OCOC—R—COO—$(CH_2)_n$— (where R represents a linear saturated aliphatic group having 2 to 20 carbon atoms and n represents an integer of from 2 to 20), which contains a polyol unit and a carboxylic acid unit), accounting for 60% by mol or more in the entire ester linkages in the entire resin. In the structure, it is more preferable when R is from 6 to 12 and n is an integer of from 6 to 12.

The crystalline polyester resin can be manufactured by an ordinary method of conducting polycondensation reaction of (1): a linear saturated aliphatic dicarboxylic acid unit or a polycarboxylic acid unit formed of its reactive derivative and (2): a polyhydric alcohol unit formed of a linear aliphatic diol is conducted.

Specific examples of the linear saturated aliphactic groups include, but are not limited to, those derived from linear saturated dihydric carboxylic acids such as 1,8-octanedicarboxylic acid, 1,9-nonane dicarboxylic acid, and 1,10-decane dicarboxylic acid.

$(CH_2)_n$ represents a linear aliphatic dihydric alcohol residual group. Specific examples of the linear aliphatic dihydric alcohol residual groups include, but are not limited to, those derived from linear aliphatic dihydric alcohols, such as ethylene glycol, propylene glycol, 1,3-propane diol, 1,4-butane diol, 1,6-hexane diol, 1,8-octane diol, 1,9-nonane diol, and 1,10-decane diol.

Since it uses a linear saturated resin dicarboxylic acid unit as the carboxylic acid unit, the crystalline polyester resin easily forms a crystalline structure in comparison with a case in which an aromatic dicarboxylic acid unit is used.

Specific examples of polycarboxylic acid units include, but are not limited to, divalent carboxylic acid units such as maronic acid, succinic acid, glutaric acid, adipic acid, suberic acid, sebacic acid, citraconic acid, phthalic acid, isophthalic acid, and terephthalic acid; and tri- or higher carboxylic acid units such as trimellitic anhydride, 1,2,4-benzene tricarboxylic acid, 1,2,5-benzene tricarboxylic acid, 1,2,4-cyclohexane tricarboxylic acid, 1,2,4-naphthalene tricarboxylic acid, 1,2,5-hexane tricarboxylic acid, 1,3-dicarboxyl-2-methylene carboxy propane, and 1,2,7,8-octane tetracarboxylic acid.

The polyhydric alcohol units optionally contain tri- or higher alcohol units in addition to a minor amount of aliphatic branched chain dihydric alcohol units or cyclic dihydric alcohol units.

The content thereof is preferably 30% by mol and more preferably 10% by mol in the entire alcohol units and such units are arbitrarily added in a range in which the thus-obtained polyester is crystalline.

Specific examples of the polyol units include, but are not limited to, 1,4-bis(hydroxymethyl)cyclohexane unit, polyethylene glycol unit, a unit of an adduct of bisphenol A with ethylene oxide, a unit of an adduct of bisphenol A with propylene oxide, and a glycerin unit.

The second binder resin is obtained by copolymerizing a unit having a polyhydroxy acid skeleton in its main chain and a crystalline polyester by a known copolymerization method. Specific examples of the methods include, but are not limited to, the following:

(1): a method of melt-kneading a unit having a polyhydroxy acid skeleton in its main chain preliminarily prepared by polymerization reaction (ring-opening polymerization of lactide or dehydration condensation of lactic acid) and a crystalline polyester preliminarily prepared by polymerization reaction followed by ester exchange reaction under a reduced pressure;

(2): a method of dissolving or dispersing in a suitable solvent a unit having a polyhydroxy acid skeleton in its main chain preliminarily prepared by polymerization reaction (ring-opening polymerization of lactide or dehydration condensation of lactic acid) and a crystalline polyester preliminarily prepared by polymerization reaction followed by reaction with an elongation agent having two or more functional groups such as an isocyanate group or an epoxy group reactive with a hydroxy group or a caroxylic acid at the end of a polymer chain; and (3): a copolymerization method of using a hydroxyl group of a crystalline polyester resin preliminarily prepared by polymerization reaction as a polymerization initiation component to obtain polylactic acid from the end of the polymer chain of the polyester resin.

The second binder resin preferably contains the crystalline resin unit accounting for 20% by weight to 80% by weight and, more preferably, 40% by weight to 60% by weight. When the content of the crystalline resin unit is too small, the melt-viscosity of the toner tends to be high. When the content of the crystalline resin unit is too large, the affinity with the first binder resin and the uniformity tend to worsen, which leads to degradation of the image quality.

The second resin has a melting point of from 50° C. to 80° C. and preferably from 60° C. to 70° C.

When the melting point of the second binder resin is too low, the second binder resin does not easily demonstrate high temperature stability because the melting point of the mother toner particle falls, which causes agglomeration of toner particles. When the melting point of the second binder resin is too high, the high temperature stability ameliorates but the low temperature fixability tends to deteriorate.

In the binder resin, the mixing ratio of the first binder resin to the second binder resin is preferably from 95/5 to 50/50.

When the ratio of the second resin is too low, the melt-viscosity of the toner does not easily decrease, which does not lead to improvement of low temperature fixability. When the ratio of the second resin is too high, the melt-viscosity of the toner lowers excessively, which causes lowering the upper limit of the fixing temperature.

Toner containing only one of the first binder resin and the second binder resin with a fixing helping agent instead of using both of the binder resins have excellent low temperature fixability but the melt-viscosity of the toner drops excessively so that the upper limit of the fixing temperature also lowers, resulting in a narrow fixing temperature range.

Fixing Helping Agent

Fixing helping agents are melting mixable materials which control the thermal properties of binder resins, are compatible therewith and demonstrate the plasticizing effect.

Any crystalline organic compound that is compatible with a binder resin and has a desired melting point can be used as the fixing helping agent of the present disclosure. Specific examples thereof include, but are not limited to, long chain aliphatic acid ester compounds, long chain aliphatic acids, long chain alcohols, aliphatic acid amides formed by amide-linking of aliphatic acids and amines, and crystalline polyesters. In particular, crystalline polyesters are preferable.

The same crystalline polyesters as those for use in the second binder resin can be used.

It is preferable that the crystalline polyester resin has a sharp molecular weight distribution in terms of low temperature fixability and in addition, the molecular weight thereof is relatively small. It is preferable that the weight average molecular weight (Mw) of the crystalline polyester resin is from 5,500 to 6,500, the number average molecular weight (Mn) thereof is from 1,300 to 1,500, and a ratio (Mw/Mn) is from 2 to 5 in the molecular weight distribution of the soluble portion of the crystalline polyester resin in tetrahydrofuran (THF) as measured by gel permeation chromatography (GPC).

The melting point of the fixing helping agent is preferably from 60° C. to 100° C. and more preferably from 65° C. to 80° C.

When the melting point is too low, the fixing helping agent easily melts, thereby degrading the high temperature stability. When the melting point is too high, toner is heated to a high temperature to melt the fixing helping agent, which easily results in insufficient low temperature fixability.

The melting point of the fixing helping agent is preferably within a range of from −15° C. to 15° C. of that of the second binder resin and, more preferably, from −10° C. to 10° C. Within this range, the fixing helping agent and the second binder resin are almost melted at the same time, so that the phase separation of the fixing helping agent and the binder resin is prevented and the low temperature fixability and the high temperature stability strike a balance due to a sharp drop of the viscoelasticity of toner.

The content of the fixing helping agent in the toner is preferably from 1% by weight to 20% by weight and more preferably from 3% by weight to 10% by weight to strike a balance between the low temperature fixability and the high temperature stability and maintain toner properties such as chargeability and definition in high levels. When the content is too small, the low temperature tends to deteriorate. When the content is too large, the area of the fixing helping agent on the surface of a toner particle increases, which degrades the fluidity of the toner particle in some cases.

Evaluation on Crystallinity

Crystallinity of the polyester resin for use in the present disclosure is evaluated by whether there is a crystalline peak as measured by an X-ray diffraction method.

The device and the condition for evaluation of the crystallinity are specified below:

X-ray diffraction (XRD) (wide-angle X-ray diffraction device: RINT-TTRIII type, manufactured by Rigaku Corporation)

X ray source: CuKα line

Tube voltage—Tube current: 50 kV-300 mA

Step width: 0.02 deg.

Measuring range: 2° to 60°

Measuring speed: 5 deg./min

Slit: 0.5 deg.-0.15 mm-0.5 deg.

Diffraction line bent crystal monochrome meter

Other Components

There is no specific limit to the other components. Specific examples thereof include, but are not limited to, a colorant (coloring agent), a releasing agent, a charge control agent, an inorganic particulate, a fluidity improver, a cleaning property improver, a magnetic material, and metal soap.

Colorant

There is no specific limit to the colorant and any known dye and pigment can be suitably selected.

Specific examples thereof include, but are not limited to, carbon black, Nigrosine dyes, black iron oxide, Naphthol Yellow S, Hansa Yellow (10G, 5G and G), Cadmium Yellow, yellow iron oxide, loess, chrome yellow, Titan Yellow, polyazo yellow, Oil Yellow, Hansa Yellow (GR, A, RN and R), Pigment Yellow L, Benzidine Yellow (G and GR), Permanent Yellow (NCG), Vulcan Fast Yellow (5G and R), Tartrazine Lake, Quinoline Yellow Lake, Anthrazane Yellow BGL, isoindolinone yellow, red iron oxide, red lead, orange lead, cadmium red, cadmium mercury red, antimony orange, Permanent Red 4R, Para Red, Faise Red, p-chloro-o-nitroaniline red, Lithol Fast Scarlet G, Brilliant Fast Scarlet, Brilliant Carmine BS, Permanent Red (F2R, F4R, FRL, FRLL and F4RH), Fast Scarlet VD, Vulcan Fast Rubine B, Brilliant Scarlet G, Lithol Rubine GX, Permanent Red F5R, Brilliant Carmine 6B, Pigment Scarlet 3B, Bordeaux 5B, Toluidine Maroon, Permanent Bordeaux F2K, Helio Bordeaux BL, Bordeaux 10B, BON Maroon Light, BON Maroon Medium, Eosin Lake, Rhodamine Lake B, Rhodamine Lake Y, Alizarine Lake, Thioindigo Red B, Thioindigo Maroon, Oil Red, Quinacridone Red, Pyrazolone Red, polyazo red, Chrome Vermilion, Benzidine Orange, perynone orange, Oil Orange, cobalt blue, cerulean blue, Alkali Blue Lake, Peacock Blue Lake, Victoria Blue Lake, metal-free Phthalocyanine Blue, Phthalocyanine Blue, Fast Sky Blue, Indanthrene Blue (RS and BC), Indigo, ultramarine, Prussian blue, Anthraquinone BlueFast Violet B, Methyl Violet Lake, cobalt violet, manganese violet, dioxane violet, Anthraquinone Violet, Chrome Green, zinc green, chromium oxide, viridian, emerald green, Pigment Green B, Naphthol Green B, Green Gold, Acid Green Lake, Malachite Green Lake, Phthalocyanine Green, Anthraquinone Green, titanium oxide, zinc oxide, lithopone and the like. These can be used alone or in combination.

There is no specific limit to the content of the colorant in the toner. The content is preferably from 1% by weight to 15% by weight and more preferably from 3% by weight to 10% by weight. When the content of the colorant is too small, the coloring performance of the toner tends to deteriorate. To the contrary, when the content of the colorant is too large, dispersion of the pigment in the toner tends to be poor, thereby degrading the coloring performance and the electric characteristics of the toner.

The colorant and the resin can be used in combination as a master batch. There is no specific limit to the resin. Specific examples of such resins include, but are not limited to, any known resins such as polyester, polymers of styrene or its substitution products, styrene-based copolymers, polymethyl methacrylate, polybutyl methacrylate, polyvinyl chloride, polyvinyl acetate, polyethylene, polypropylene, epoxy resins, epoxy polyol resins, polyurethane, polyamide, polyviny butyral, polyacrylic acid resin, rosin, modified rosin, terpene resin, aliphatic hydrocarbon resins, alicyclic hydrocarbon resins, aromatic petroleum resins, chlorinated paraffin, and paraffin wax. In terms of dispersability, polylactic acid is preferable and the same resins as those for the first binder resin are usable.

These can be used alone or in combination.

The master batch is prepared by mixing or kneading the resin for the master batch mentioned above and the colorant mentioned above upon application of high shear stress thereto. In this case, an organic solvent is preferably used to boost the interaction between the colorant and the resin.

In addition, so-called flushing methods are advantageous in that there is no need to drying because a wet cake of the coloring agent can be used as they are. In the flushing method, a water paste containing water of a colorant is mixed or kneaded with an organic solvent and the colorant is transferred to the resin side to remove water and the organic solvent component. High shearing dispersion devices such as a three-roll mill, etc. can be used for mixing or kneading.

Releasing Agent

There is no specific limit to the releasing agent. A releasing agent having a low melting point, for example, from 50° C. to 120° C. is preferable. By dispersing the releasing agent having such a low melting point with the resin mentioned above, it serves well between a fixing roller and the toner interface. For this reason, the hot offset resistance is good even when no releasing agent such as oil is applied to a fixing roller.

Waxes are preferably used as the releasing agent.

Specific examples of such waxes include, but are not limited to, natural waxes, for example, plant waxes such as carnauba wax, cotton wax, vegetable wax, and rice wax; animal waxes such as bee wax and lanolin; mineral waxes such as ozokerite; petroleum waxes such as paraffin, microcrystalline, and petrolatum.

In addition to these natural waxes, synthesis hydrocarbon waxes such as Fischer-Tropsch wax and polyethylene wax and synthesis wax such as ester, ketone, and ether are also usable. Furthermore, aliphatic acid amide such as 12-hydroxystearic acid amide, stearic acid amide, phthalic acid anhydride imide, and chlorinated hydrocarbons; crystalline polymer resins having a low molecular weight such as homo polymers, for example, poly-n-stearylic methacrylate and poly-n-lauryl methacrylate, and copolymers (for example, copolymers of n-stearyl acrylate-ethylmethacrylate); and crystalline polymer having a long alkyl group in the branched chain are also usable. These can be used alone or in combination.

There is no specific limit to the melting point of the releasing agent. The melting point is preferably from 50° C. to 120° C. and more preferably from 60° C. to 90° C. When the melting point of the releasing agent is too low, the high temperature stability of the toner tends to deteriorate. In contrast, when the melting point is too high, a cold offset problem, i.e., an offset phenomenon that occurs at a low fixing temperature, tends to occur.

The releasing agent preferably has a melt viscosity of from 5 cps to 1,000 cps and more preferably from 10 cps to 100 cps at a temperature 20° C. higher than the melting point of the wax (releasing agent).

When the melt viscosity is too low, the releasing property may deteriorate. When the melt viscosity is too high, the hot offset resistance and the low temperature fixing property are not easily improved.

There is no specific limit to the content of the releasing agent in the toner. For example, the content is preferably 40% by weight or less and more preferably from 3% by weight to 30% by weight. When the content of the releasing agent is too large, the fluidity of the toner may deteriorate.

Charge Control Agent

There is no specific limit to the selection of the charge control agent. Specific examples of the charge control agent include, but are not limited to, known charge control agents such as nigrosine dyes, triphenylmethane dyes, chrome containing metal complexes, chelate compounds of molybdic acid, Rhodamine dyes, alkoxyamines, quaternary ammonium salts (including fluorine-modified quaternary ammonium salts), alkylamides, phosphor and compounds including phosphor, tungsten and compounds including tungsten, fluorine-containing activators, metal salts of salicylic acid and metal salts of salicylic acid derivatives. These can be used alone or in combination.

Charge control agents available from the market can be used. Specific examples thereof include, but are not limited to, BONTRON P-03 (nigrosine-based dye), BONTRON P-51 (quaternary ammonium salt), BONTRON S-34 (metal-containing azo dye), E-82 (metal complex of oxynaphthoic acid), E-84 (metal complex of salicylic acid), and E-89 (phenolic condensation product), which are manufactured by Orient Chemical Industries Co., Ltd.; TP-302 and TP-415 (molybdenum complex of quaternary ammonium salt), which are manufactured by Hodogaya Chemical Co., Ltd.; COPY CHARGE PSY VP2038 (quaternary ammonium salt), COPY BLUE PR (triphenyl methane derivative), COPY CHARGE NEG VP2036 and NX VP434 (quaternary ammonium salt), which are manufactured by Hoechst AG; LRA-901 and LR-147 (boron complex), which are manufactured by Japan Carlit Co., Ltd.; copper phthalocyanine, perylene, qinacridone, azo-based pigments, and polymers having a functional group such as a sulfonate group, a carboxyl group, a quaternary ammonium basic group, etc.

The content of the charge control agent in the toner depends on the kind of the resin, presence of additives, and dispersion method so that it is not simply regulated but, for example, is preferably from 0.1 parts by weight to 10 parts by weight and more preferably from 0.2 part by weight to 5 parts by weight to 100 parts by weight to the binder resin. When the content is too low, the charge control property is not easily obtained. When the content is too high, the toner tends to have an excessive chargeability, thereby decreasing the effect of the main charge control agent, increasing the force of electrostatic attraction with the development roller and inviting deterioration of the fluidity of the toner and a decrease in the image density.

Inorganic Particulate

The inorganic particulates are used to impart toner particles with fluidity, developability, and chargeability as an external additive.

Any known inorganic particle can be suitably selected and specific examples thereof include, but are not limited to, silica, alumina, titanium oxide, barium titanate, magnesium titanate, calcium titanate, strontium titanate, zinc oxide, tin oxide, quartz sand, clay, mica, sand-lime, diatom earth, chromium oxide, cerium oxide, red iron oxide, antimony trioxide, magnesium oxide, zirconium oxide, barium sulfate, barium carbonate, calcium carbonate, silicon carbide, silicon nitride, etc. It is preferable that these are treated with a fluidity improver.

These can be used alone or in combination.

The inorganic particulate preferably has a primary particle diameter of from 5 nm to 2 μm, and more preferably from 5 nm to 500 nm.

The content of the external additive is preferably from 0.01% by weight to 5% by weight, and more preferably from 0.01% by weight to 2.0% by weight in the toner.

Fluidity Improver

The fluidity improver is prepared by surface treatment to improve the hydrophobic property and prevent deterioration of the fluidity and the chargeability even in a humid environment. Specific examples of the fluidity improver include, but are not limited to, silane coupling agents, silylating agents, silane coupling agents including an alkyl fluoride group, organic titanate coupling agents, aluminum containing coupling agents, silicone oil, and modified silicone oil. Hydrophobic silica and hydrophobic titanium oxide, which are formed by surface-treating the silica and the titanium oxide mentioned above with such a fluidity improver are particularly preferable.

Cleaning Property Improver

The cleaning property improver is added to the toner to remove the development agent remaining on the image bearing member (photoreceptor) or a primary intermediate transfer element after transfer of an image. Specific examples thereof include, but are not limited to, zinc stearate, calcium stearate, and aliphatic metal salts of stearic acid, polymer particulates such as polymethyl methacrylate particulates and polystyrene particulates, which are prepared by a soap-free emulsion polymerization method. The polymer particulates preferably have a relatively narrow particle size distribution and the volume average particle diameter thereof is preferably from 0.01 μm to 1 μm.

Magnetic Material

There is no specific limit to the magnetic materials and any known magnetic materials can be suitably used. Specific examples thereof include, but are not limited to iron powder, magnetite, and ferrite. Among these, white materials are preferable in terms of coloring.

Toner Property

Half Effusion Temperature

The toner of the present disclosure preferably has a half effusion temperature of from 80° C. to 120° C. and more preferably from 90° C. to 110° C. as measured by a temperature rising method using an elevated flow tester.

When the half effusion temperature is too low, if the fixing temperature is high, the melt-viscosity of melted toner is too low, the upper part of a toner image tends to be attached to a fixing member during fixing, which is referred to as hot offset phenomenon. When the half effusion temperature is too high, heating during fixing is not sufficient to lower the melt-viscosity of toner, so that the low temperature fixability easily deteriorates and the toner easily peels off from a fixed image.

Weight Average Molecular Weight

The toner of the present disclosure preferably has a weight average molecular weight of the portion soluble in tetrahydrofuran ranging from 20,000 to 50,000 and, more preferably, from 25,000 to 40,000.

When the weight average molecular weight is too large, the entire binder resin has an excessively large molecular weight, which causes degradation of the fixability and gloss and easy peeling-off of an image after fixing due to an external stress. In addition, when the weight average molecular weight is too small, hot offset tends to occur, thereby degrading the image quality because the internal agglomeration force is weak when the fixing temperature is high although no problem occurs when the fixing temperature is low.

If the melt-viscosity of toner after melting is controlled by the molecular weight, as the molecular weight increases, the melt-viscosity increases because the transfer of the molecular chain is prevented more. Furthermore, when the molecular weight is large, entanglement occurs, which leads to elastic behavior. In view of the fixing property to paper, a smaller molecular weight is preferable because the viscosity is low during fixing but hot offset occurs without viscosity in some degree. However, if the entire molecular weight increases, the fixability deteriorates. With regard to thick paper in particular, the fixing state furthermore deteriorates since the heat conductivity to toner during fixing is low.

Method of Manufacturing Toner

The method of manufacturing toner for use in the present disclosure is described next.

The toner of the present disclosure is manufactured by emulsifying and/or dispersing an oil phase in an aqueous medium followed by removal of an organic solvent. The oil phase is formed by dissolving or dispersing a toner material that contains a colorant, a binder resin containing a resin having a polyhydroxy carboxylic acid skeleton, and other optional materials such as a fixing helping agent and a releasing agent in an organic solvent.

Solution or Liquid Dispersion of Toner Material

The oil phase in which toner materials are dissolved or dispersed is prepared by dissolving or dispersing the toner materials in an organic solvent. Any toner material that can form toner is usable. For example, the toner material contains a binder resin, a colorant, and the other optional components mentioned above such as a fixing helping agent, a releasing agent, and a charge control agent. It is preferable to remove the organic solvent during or after granulation of toner.

Organic Solvent

There is no specific limit to the selection of the organic solvent as long as it can dissolve or disperse the toner material. In terms of easy removal, it is suitable to select a volatile organic solvent having a boiling point of 150° C. or lower.

Specific examples of such solvents include, but are not limited to, toluene, xylene, benzene, carbon tetrachloride, methylene chloride, 1,2-dichloroethane, 1,1,2-trichloroethane, trichloroethylene, chloroform, monochlorobenzene, dichloroethylidene, methyl acetate, ethyl acetate, methyl ethyl ketone, methyl isobutyl ketone, etc. Among these, toluene, xylene, benzene, methylene chloride, 1,2-dichloroethane, chloroform, and carbon tetrachloride are preferable and ethyl acetate is particularly preferable. These can be used alone or in combination. There is no specific limit to the amount of the organic solvent.

Aqueous Medium

There is no specific limit to the aqueous medium. Specific examples thereof includes, but are not limited to, known aqueous media such as water, a solvent mixable with water, and a mixture thereof. Water is particularly preferable.

Specific examples of such water-mixable solvents include, but are not limited to, alcohols, dimethylformamide, tetrahydrofuran, cellosolves, and lower ketones. Specific examples of the alcohols include, but are not limited to, methanol, isopropanol, and ethylene glycol.

Specific examples of the lower ketones include, but are not limited to, acetone and methyl ethyl ketone.

These can be used alone or in combination.

It is preferable to contain resin particulates in the aqueous medium. Due to the resin particulates, mother toner particles are stably dispersed, so that a toner having a small particle diameter and a sharp particle size distribution can be manufactured.

In addition, it is possible to improve the high temperature stability by attaching the resin particulates to prepared mother toner particles and fixing them on the surface thereof by heating.

In preparation of an aqueous medium in a case in which resin particulates are attached to and fixed on mother toner particles, for example, it is preferable to disperse the resin particulates in the aqueous medium under the presence of an anionic surfactant.

In a case in which the resin particulates have agglomeration property with an anionic surfactant, it is preferable to disperse them by a high-speed shearing device before emulsification of an aqueous medium.

Anionic Surfactant

Specific examples of anionic surfactants for use in manufacturing toner of the present disclosure include, but are not limited to, alkylbenzene sulfonic acid salts, α-olefin sulfonic acid salts, and phosphoric acid esters.

An anionic surfactant having a fluoroalkyl group is preferable. Specific examples of the anionic surface active agents having a fluoroalkyl group include, but are not limited to, fluoroalkyl carboxylic acids having 2 to 10 carbon atoms and their metal salts, disodium perfluorooctane sulfonylglutamate, sodium 3-{omega-fluoroalkyl (having 6 to 11 carbon atoms) oxy}-1-alkyl (having 3 to 4 carbon atoms) sulfonate, sodium 3-{omega-fluoroalkanoyl (having 6 to 8 carbon atoms)-N-ethylamino}-1-propanesulfonate, fluoroalkyl (having 11 to 20 carbon atoms) carboxylic acids and their metal salts, perfluoroalkylcarboxylic acids and their metal salts, perfluoroalkyl (having 4 to 12 carbon atoms) sulfonate and their metal salts, perfluorooctanesulfonic acid diethanol amides, N-propyl-N-(2-hydroxyethyl)perfluorooctanesulfone amide, perfluoroalkyl (having 6 to 10 carbon atoms) sulfoneamidepropyltrimethylammonium salts, salts of perfluoroalkyl (having 6 to 10 carbon atoms)-N-ethylsulfonyl glycin, and monoperfluoroalkyl (having 6 to 16 carbon atoms) ethylphosphates.

Specific examples of the anionic surfactants having a fluoroalkyl group available from the market include, but are not limited to, SURFLON S-111, S-112 and S-113, which are manufactured by Asahi Glass Co., Ltd.; FRORARD FC-93, FC-95, FC-98 and FC-129, which are manufactured by Sumitomo 3M Ltd.; UNIDYNE DS-101 and DS-102, which are manufactured by Daikin Industries, Ltd.; MEGAFACE F-110, F-120, F-113, F-191, F-812 and F-833 which are manufactured by DIC Corporation; ECTOP EF-102, 103, 104, 105, 112, 123A, 306A, 501, 201 and 204, which are manufactured by Tohchem Products Co., Ltd.; and FUTARGENT F-100 and F150 manufactured by Neos Company limited.

There is no specific limit to the addition amount of the anionic surfactant to the aqueous medium. For example, it is preferably from 0.5% by weight to 10% by weight.

Resin Particulate

Any known resin that can form an aqueous liquid dispersion in an aqueous medium is usable as a resin for the resin particulate for use in the present disclosure. For example, a thermal plastic resin and a thermal curing resin are suitable.

Specific examples thereof include, but are not limited to, vinyl resins, polyurethane resins, epoxy resins, polyester resins, polyamide resins, polyimide resins, silicone resins, phenolic resins, melamine resins, urea resins, aniline resins, ionomer resins, and polycarbonate resins.

These can be used alone or in combination.

Among these resins, vinyl resins, polyurethane resins, epoxy resins, polyester resins, and mixtures thereof are preferably used because an aqueous liquid dispersion including fine spherical particles can be easily prepared.

Specific examples of the vinyl resins include, but are not limited to, polymers, which are prepared by polymerizing a vinyl monomer or copolymerizing vinyl monomers, such as styrene-(meth)acrylate resins, styrene-butadiene copolymers, (meth)acrylic acid-acrylate copolymers, styrene-acrylonitrile copolymers, styrene-maleic anhydride copolymers, and styrene-(meth)acrylic acid copolymers.

Resin particulates that are anionic are preferable. If the resin particulate is anionic, agglomeration can be inhibited when used with the anionic surfactant mentioned above.

Such anionic resin particulates are manufactured by using an anionic activator or introducing an anionic group such as a carboxylic acid group or a sulfonic acid group into a resin.

Resin particulates can be obtained through polymerization using any known method. It is preferred to obtain as an aqueous liquid dispersion of resin particulates. For example, as the method of preparing an aqueous liquid dispersion of the resin particulates, the following methods of (1) to (8) can be used.

(1) In the case of a vinyl resin, a method of manufacturing an aqueous liquid dispersion of resin particulates directly from the polymerization reaction by a suspension polymerization method, an emulsification polymerization method, a seed polymerization method, or a dispersion polymerization method using a vinyl monomer as the initial material of the resin particulates.

(2) In the case of a polyaddition-based or polycondensation-based resin such as a polyester resin, a polyurethane resin, and an epoxy resin, a method of manufacturing an aqueous liquid dispersion of resin particulates by: dispersing a precursor (monomer, oligomer, etc.) or its solvent solution under the presence of a suitable dispersion agent; curing the liquid dispersion by heating or addition of a curing agent.

(3) In the case of a polyaddition or polycondensation resin such as a polyester resin, a polyurethane resin and an epoxy resin, a method of manufacturing an aqueous liquid dispersion of resin particulates by dissolving a suitable emulsification agent in a precursor (monomer, oligomer, etc.) or its solvent solution (liquid is preferred, e.g., liquidized by heating) followed by adding water for phase change.

(4) A method of pulverizing a resin preliminarily manufactured by a polymerization reaction (addition polymerization, ring scission polymerization, polyaddition, addition condensation, polycondensation, etc.) with a fine grinding mill of a mechanical rotation type or jet type, classifying the resultant to obtain resin particulates, and dispersing the resin particulates in water under the presence of a suitable dispersion agent.

(5) A method of spraying a resin solution in which a preliminarily manufactured resin by a polymerization reaction (addition polymerization, ring scission polymerization, polyaddition, addition condensation, polycondensation, etc.) is dissolved in a solvent in a form of a fine liquid mist to obtain resin particulates followed by dispersion thereof in water under the presence of a suitable dispersion agent.

(6) A method of adding a solvent to a resin solution in which a preliminarily manufactured resin by a polymerization reaction (addition polymerization, ring scission polymerization, polyaddition, addition condensation, polycondensation, etc.) is dissolved in a solvent or cooling down a resin solution preliminarily prepared by dissolving the resin in a solvent by heating to precipitate resin particulates; removing the solvent to obtain the resin particulates; and dispersing them in water under the presence of a dispersion agent.

(7) A method of dispersing a resin solution in which a preliminarily manufactured resin by a polymerization reaction (addition polymerization, ring scission polymerization, polyaddition, addition condensation, polycondensation, etc.) is dissolved in a solvent in an aqueous medium under the presence of a suitable dispersion agent; and removing the solvent by heating, reduced pressure, etc.

(8) A method of dissolving a suitable emulsifying agent in a resin solution in which a preliminarily manufactured resin by a polymerization reaction (addition polymerization, ring opening polymerization, polyaddition, addition condensation, polycondensation, etc.) is dissolved in a solvent; and adding water to the solution for phase change emulsification.

The toner of the present disclosure preferably has a weight average particle diameter of from 5 nm to 50 nm and more preferably from 10 nm to 25 nm. This range is suitable to control the particle diameter and the particle size distribution of mother toner particles.

The particle diameter can be measured by scanning electron microscopy (SEM), transmission electron microscopy (TEM), a light scattering method, etc. Preferably, using LA-920 (manufactured by Horiba Ltd.) according to a laser scattering measuring method, the particle diameter is measured after dilution for a suitable measuring range. The volume average particle diameter is measured as the particle diameter.

There is no specific limit to the addition amount of the resin particulate to the aqueous medium. For example, it is preferably from 0.5% by weight to 10% by weight.

Emulsification and/or Dispersion

With regard to emulsification and/or dispersion of the oil phase containing the toner material in the aqueous medium, it is preferable to stir the oil phase containing the toner material in the aqueous medium to conduct dispersion.

There is no specific limit to the dispersion method and any known fixing device can be suitably used.

Specific examples of the dispersion device include, but are not limited to, a low speed shearing type dispersion device and a high speed shearing type dispersion device. In emulsification and/or dispersion in the manufacturing method of the toner of the present disclosure, the resin particulates can be added into an aqueous medium during or after emulsification.

Whether the resin particulates are added during dispersion using a high speed shearing dispersion device or during low speed stirring switched after emulsification depends on the attachability of the cross-linked resin particulate to toner particles and the observation on the progress of fixing thereof.

The toner of the present disclosure preferably has a ratio of volume average particle diameter Dv to the number average particle diameter Dn ranging from 1.00 to 1.30. When this ratio is too large, the chargeability tends to vary among particles, which leads to degradation of the image quality.

Measuring Method of Toner Property

Weight Average Particle Diameter Dw, Volume Average Particle Diameter Dv, and Number Average Particle Diameter Dn The weight average particle diameter Dw, the volume average particle diameter Dv, and the number average particle diameter Dn are measured by using a particle size measuring instrument (MULTISIZER III, manufactured by BECKMAN COULTER INC.) with an aperture diameter of 100 μm and the measuring results are analyzed by an analysis software (BECKMAN COULTER MULTISIZER 3 VERSION 3.51). To be specific, 0.5 ml of 10% by weight surfactant (alkylbenzene sulfonate, NEOGEN SC-A, manufactured by Daiichi Kogyo Co., Ltd.) is placed in a glass beaker (100 ml) and thereafter, 0.5 g of each toner is added in the beaker and stirred by a microspatula. Subsequently, 80 ml of deionized water is added to the mixture. The thus-obtained liquid dispersion is subject to dispersion treatment for ten minutes using an ultrasonic wave dispersion device (W-113MK-II, manufactured by Honda Electronics). The liquid dispersion is measured by using the MULTISIZER III using ISOTON® III (manufactured by BECKMAN COULTER INC.) as the measuring solution. The liquid dispersion is dripped such that the concentration indicated by the measuring device is from 6% to 10%. In this measuring method, it is desirable to keep the density in the range mentioned above in terms of measuring reproducibility. The measured particle diameter does not have an error when the density is in that range.

Measuring of Weight Average Molecular Weight

A measuring instrument (GPC-8020, manufactured by Tosoh Corporation) is used with three columns (TSKgel Super HZM-H) linked. The measurement is conducted according to the following procedure.

The columns are stabilized in a heat chamber at 40° C.; a solvent of THF is flown into the column at a flow speed of 0.35 ml; and 10 μl of a THF sample solution of toner and resin prepared to have a sample concentration of from 0.05% by weight to 0.6% by weight is poured for measuring. The weight average molecular weight Mw, the number average molecular weight Mn, and the peak top molecular weight Mp are obtained by using the molecular weight distribution of the sample, which is calculated based on the relations between the logarithm values of the standard curves made from several kinds of the monodispersed polystyrene standard samples and the count values. As the polyesyrene standard samples for drawing the standard curves, Showdex STANDARD series (manufactured by Showa Denko k.K.) having MPs of 6,540,000, 3,570,000, 651,000, 251,000, 110,000, 45,000, 19,300, 6,700, 2,800, and 580 and toluene are used and an refraction index (RI) detector is used as the detector.

The toner of the present disclosure can be used as a single component development agent or a two component development agent formed by mixing with carrier.

Image Forming Method

The full color image forming method in the present disclosure includes: charging a photoreceptor (image bearing member) with a charger; irradiating the charged photoreceptor with an irradiator to form a latent electrostatic image thereon; developing the latent electrostatic image with toner by a development device to form a toner image on the photoreceptor; primarily transferring the toner image on the photoreceptor to an intermediate transfer medium by a primary transfer device; secondarily transferring the toner image transferred onto the intermediate transfer medium to a recording medium by a secondary transfer device; fixing the toner image transferred onto the recording medium by a fixing device that includes heat and pressure fixing members; and cleaning the surface of the photoreceptor to remove residual toner attached thereto by a cleaner after the toner image is transferred to the intermediate transfer medium.

The toner in developing is the toner of the present disclosure. In the full color image forming method, it is preferable that the linear speed of transfer, so-called printing speed of the toner to the recording medium in the secondary transfer is from 100 mm/s to 1,000 mm/s and the transfer time at the nipping portion of the secondary transfer device is from 0.5 msec. to 60 msec.

Furthermore, the full color image forming method is preferably executed by a tandem type, which has multiples sets of a photoreceptor, a charger, an irradiator, a development device, a primary transfer device, and a cleaner.

In the tandem type having multiple photoreceptors each of which is arranged to form and develop a single color image in synchronization with its rotation, a latent electrostatic image is formed, developed, and transferred per color to form a single color toner image. For this reason, there is little difference between the speeds of forming a monochrome image and a full color image, which is advantageous in terms of printing performance. However, since each color toner layer is formed by a separate photoreceptor and superimposed to form a full color image, for example, the chargeability differs among the toner particles by color. Such variation on properties of toner particles causes the difference about the amount of development toner by color. This leads to a large color phase variation of the secondary color by superimposition, thereby degrading the color reproducibility.

With regard to the toner for use in the image forming method using a tandem system, it is suitable to stabilize the amount of development toner to control the balance between each color (no variation among the toner particles by color) and unify the attachability of the toner particles to a photoreceptor and a recording medium by color. The toner of the present disclosure is suitable from this point of view.

A charger that applies a direct voltage on which at least an alternate voltage is superimposed is preferable. By applying a direct voltage on which at least an alternate voltage is superimposed, the surface voltage of a photoreceptor can be stabilized at a desired value, which leads to achieving uniform charging in comparison with a case in which only a direct voltage is applied.

Furthermore, a charger is preferable which applies a voltage to a charging member and brings the charging member into contact with a photoreceptor to conduct charging. Since the charging member contacts the photoreceptor and a bias is applied to the charging member, in particular the uniform chargeability achieved by applying a direct voltage on which an alternative voltage is superimposed is furthermore improved.

The fixing device has a heating roller made of a magnetic metal and heated by electromagnetic induction, a fixing roller arranged parallel to the heating roller, an endless toner heating medium (heating belt) which is stretched between the heating roller and the fixing roller, heated by the heating roller, and rotated by both rollers, and a pressure roller that is pressed against the fixing roller via the heating belt and rotates in the trailing direction of the heating belt to form a nipping portion. Due to this structure, the temperature of the fixing belt rises in a short period of time and the temperature is stably controlled.

In addition, when a recording medium having a rough surface is used, a fixing belt conforms to the surface in some degree during fixing so that sufficient fixability is maintained.

It is preferable that the fixing device adopts a no or little oil application system. For this reason, using toner particles having a releasing agent (wax) finely-dispersed therein is preferable.

By using a releasing agent finely-dispersed in toner particles, the releasing agent easily exudes during fixing so that transfer of the toner to the belt is prevented in an oil-free fixing device or a little oil application fixing device even when the oil application effect decreases.

Using a releasing agent incompatible with a binder resin is preferable to disperse the releasing agent in toner particles. In addition, one way to finely-disperse the releasing agent in toner particles is to use a shearing force when dissolving and/or dispersing toner materials in an organic solvent.

The dispersion of the releasing agent can be observed by a TEM using a thin-layer segment of a toner particle.

A releasing agent having a smaller dispersion diameter is preferable but a releasing agent having an excessively small dispersion diameter does not exude sufficiently during fixing in some cases.

For this reason, when a releasing agent is confirmed by a TEM with a magnifying power of 10,000×, the releasing agent is determined as dispersed. That is, a releasing agent which is not observed with a magnifying power of 10,000× does not exude sufficiently during fixing in some cases even if it is finely-dispersed.

Having generally described (preferred embodiments of) this invention, further understanding can be obtained by reference to certain specific examples which are provided herein for the purpose of illustration only and are not intended to be limiting. In the descriptions in the following examples, the numbers represent weight ratios in parts, unless otherwise specified.

EXAMPLES

Next, the present disclosure is described in detail with reference to Examples but not limited thereto.

Synthesis Example 1

Synthesis of Second Binder Resin (2-A)

68.9 parts of sebacic acid, 31.1 parts of 1,3-propane diol, and 0.2 parts of dibutyl tin oxide were placed in a flask equipped with a nitrogen introducing tube, a dehydration tube, a stirrer, and a thermocouple. Subsequent to reaction at 180° C. for 10 hours, the system was heated to 200° C. and reacted for 3 hours followed by two-hour reaction at 8.3 kPa to obtain [binder resin a] of a crystalline resin unit.

Furthermore, 50 parts of the crystalline resin a, 50 parts of polylactic acid (VYLOECOL® BE-410, manufactured by Tosoh Corporation) having a glass transition temperature of 48.8° C. as a non-crystalline resin unit, and 0.2 parts of dibutyl tin oxide were placed in a flask equipped with a nitrogen introducing tube, a dehydration tube, a stirrer, and a thermocouple followed by 2-hour reaction at 180° C. to obtain a second binder resin A. The thus-obtained second binder resin 2-A had a melting point of 50.5° C.

Synthesis Examples 2 to 5

Synthesis of Second Binder Resins (2-B to 2-E)

Second binder resins 2-B to 2-E were manufactured in the same manner as in Synthesis Example 1 except that the contents of the crystalline resin unit material were changed as shown in Table 1.

TABLE 1

| Component | Second binder resin | | | | |
|---|---|---|---|---|---|
| (parts by weight) | 2-A | 2-B | 2-C | 2-D | 2-E |
| Sebacic acid | 68.9 | 58.8 | 73.1 | 68.9 | 68.9 |
| 1,3-propane diol | 31.1 | 0.0 | 0.0 | 0.0 | 0.0 |
| 1,6-hexane diol | 0.0 | 41.2 | 0.0 | 0.0 | 0.0 |
| Ethylene glycol | 0.0 | 0.0 | 26.9 | 0.0 | 12.7 |
| Propylene glycol | 0.0 | 0.0 | 0.0 | 31.1 | 0.0 |
| 1,4-butane diol | 0.0 | 0.0 | 0.0 | 0.0 | 18.4 |
| Dibutyl tin oxide | 0.2 | 0.2 | 0.2 | 0.2 | 0.2 |

Synthesis Example 6

Synthesis of Second Binder Resin (2-F)

50 parts of a crystalline polyester resin (VYLON® GA-6400, manufactured by Toyobo Co., Ltd.), 50 parts of polylactic acid (VYLOECOL® BE-410, manufactured by Tosoh Corporation) having a glass transition temperature of 48.8° C. as a non-crystalline resin unit, and 0.2 parts of dibutyl tin oxide were placed in a flask equipped with a nitrogen introducing tube, a dehydration tube, a stirrer, and a thermocouple followed by 2-hour reaction at 180° C. to obtain a second binder resin 2-F The thus-obtained second binder resin 2-F had a melting point of 88.5° C.

Next, the second binder resins 2-A to 2-F were evaluated as follows:

The results are shown in Table 2.

Measuring of Melting Point and Glass Transition Temperature

The melting point and the glass transition temperature were determined as follows: These were measured in the following measuring conditions by using TA-60WS and DSC-60, manufactured by Shimadzu Corporation.

Measuring Conditions

Sample container: Aluminum sample pan (with a lid)

Sample amount: 5 mg

Reference: Aluminum sample pan (alumina 10 mg)

Atmosphere: nitrogen (flow amount: 50 ml/min)

Temperature Conditions

Starting Temperature: 20° C.

Heating speed: 10° C./min

Ending temperature: 150° C.

Holding time: None

Cooling speed: −10° C./min

Ending temperature: −20° C.

Holding time None

Heating speed: 10° C./min

Ending temperature: 150° C.

TABLE 2

| Second binder resin | Melting point (° C.) |
|---|---|
| 2-A | 50.5 |
| 2-B | 61.2 |
| 2-C | 72.0 |
| 2-D | No melting point |
| 2-E | 45.0 |
| 2-F | 88.5 |

Synthesis Example 7

Synthesis of First Binder Resin (1-B)

850 parts of L-lactide, 150 parts of D-lactide, 10 parts of ethylene glycol, and 0.2 parts of dibutyl tin oxide were placed in a flask equipped with a nitrogen introducing tube, a dehydration tube, a stirrer, and a thermocouple. Subsequent to reaction at 190° C. for 2 hours, the system was reacted for an hour at 1 kPa to obtain a non-crystalline [First binder resin 1-B].

The thus-obtained first binder resin 1-B had an Mw of 12,000 and a Tg of 51° C.

Synthesis Example 8

Synthesis of Crystalline Polyester Resin 2,300 g of 1,10-decan diacid, 2,530 g of 1,8-octane diol, and 4.9 g of hydroquinone were placed in a flask equipped with a nitrogen introducing tube, a dehydration tube, a stirrer, and a thermocouple. Subsequent to reaction at 180° C. for 10 hours, the system was heated to 200° C. and reacted for 3 hours followed by two-hour reaction at 8.3 kPa to obtain a crystalline polyester resin.

The crystalline polyester resin had a melting point of 64.8° C.,

Synthesis Example 9

Synthesis of Anionic Resin Particulate

The following recipe was placed in a container equipped with a stirrer and a thermometer and stirred at 400 rpm for 15 minutes to obtain a white emulsion:

| | |
|---|---|
| Water | 683 parts |
| Sodium salt of sulfate of an adduct of methacrylic acid with ethyleneoxide (EREMINOR RS-30, manufactured by Sanyo Chemical Industries, Ltd.) | 16 parts |
| Styrene | 83 parts |
| Methacrylic acid | 83 parts |
| Butyl acrylate | 110 parts |
| Ammonium persulfate | 1 part |

The system was heated to 75° C. to conduct reaction for five hours. Furthermore, 30 parts of 1% ammonium persulfate aqueous solution followed by aging at 75° C. for five hours to obtain an aqueous liquid dispersion of [Anionic resin particulate liquid dispersion] of a vinyl resin (copolymer of styrene-methacrylic acid-butyl acrylate-sodium salt of sulfate of an adduct of methacrylic acid with ethyleneoxide. [Anionic resin particulate liquid dispersion] had a volume average particle diameter (measured by LA-920, manufactured by Horiba Corporation) of 38 nm, a weight average molecular weight of 420,000, and a Tg of 63° C.

Example 1

Preparation of Master Batch 1,000 parts of water, 540 parts of carbon black (Printex 35, DBP oil absorption amount=42 ml/100 g, pH=9.5, manufactured by Degussa AG.), and 1,200 parts of the first binder resin 1-A (VYLOECOL® BE-410, manufactured by Tosoh Corporation) were mixed by a HENSCHEL MIXER (manufactured by NIPPON COKE & ENGINEERING CO., LTD.)

Subsequent to kneading the mixture by two rolls at 150° C. for 30 minutes, the resultant was rolled and cooled down by a pulverizer (manufactured by Hosokawa Micron Corporation) to prepare a master batch.

Preparation of Liquid Dispersion of Fixing Helping Agent 100 g of the crystalline polyester resin and 400 g of ethyl acetate were placed in a metal container and melted by heating at 75° C. followed by rapid cooling-down at a cooling speed of −27° C./min in ice water bathing. 500 ml of glass beads (3 mm ϕ) was added followed by pulverization by a batch type sand mill (manufactured by Kanpe Hapio Co., Ltd.) to obtain [Crystalline polyester liquid dispersion].

Preparation of Oil Phase 50 parts of the first binder resin 1-A (VYLOECOL® BE-410, manufactured by Tosoh Corporation), 50 parts of the second binder resin 2-A, 130 parts of ethyl acetate, and 25 parts of the crystalline polyester liquid dispersion were dissolved in a beaker by stirring.

Next, 10 parts of carnauba wax (molecular weight: 1,800, acid value: 2.5, penetration degree: 15 mm (40° C.) and 10 parts of the master batch were placed in a bead mill (ULTRA VISCO MILL, manufactured by IMEX Co., Ltd.) in the conditions of a liquid sending speed of 1 kg/h, a disk perimeter speed of 6 m/s, 80% by volume filling of 0.5 mm zirconia beads, and 3 passes to prepare a material solution of [Solution and/or liquid dispersion of toner material], which was defined as [Oil phase].

Preparation of Aqueous Medium 660 parts of water, 25 parts of the anionic resin particulate liquid dispersion, 25 parts of 48.5 weight % aqueous solution of sodium dodecyldiphenyl etherdisulfonate (EREMINOR MON-7, manufactured by Sanyo Chemical Industries, Ltd.), and 60 parts of ethyl acetate were mixed and stirred to obtain milk white liquid (aqueous phase).

The agglomeration elements of the aqueous medium were loosened by stirring at 8,000 rpm by a TK type HOMOMIXER (manufactured by PRIMIX Corporation) so that small agglomeration elements having a size of several μm were dispersed in the aqueous medium, which was observed by an optical microscope.

Preparation of Emulsion and/or Liquid Dispersion 150 parts of the aqueous medium was placed in a container and stirred at 12,000 rpm by a TK type HOMOMIXER (manufactured by PRIMIX Corporation). 100 parts of [Solution and/or liquid dispersion of toner material] was added thereto followed by mixing for 10 minutes to prepare an emulsion and/or liquid dispersion, which was defined as [Emulsified slurry].

Removal of Organic Solvent 100 parts of the emulsified slurry was placed in a flask equipped with a pipe for degassing, a stirrer, and a thermometer and stirred at a stirring speed of 20 m/min to remove the solvent at 30° C. with a reduced pressure for 12 hours. Thus, [Solvent-removed slurry] was obtained.

Washing

After all of [Solvent-removed slurry] was filtered with a reduced pressure, 300 parts of deionized water was added to the filtered cake and mixed and re-dispersed by a TK HOMOMIXER at 12,000 rpm for 10 minutes followed by filtration. 300 parts of deionized water was added to the thus-obtained filtered cake and the resultant was mixed by a TK HOMOMIXER at 12,000 rpm for 10 minutes followed by filtration, which was repeated three times. The resultant having a conductivity of the re-dispersed slurry ranging from 0.1 μS/cm to 10 μS/cm was defined as [Washed slurry] followed by filtration.

Drying

The obtained filtered cake was dried by a circulation drier at 45° C. for 48 hours. The dried cake was sieved using a screen having an opening of 75 μm to obtain [Mother toner particle a].

External Addition Treatment 100 parts of [Mother toner particle a], 0.6 parts of hydrophobic silica having an average particle diameter of 100 nm, 1.0 part of titanium oxide having an average particle diameter of 20 nm, and 0.8 parts of fine powder of hydrophobic silica having an average particle diameter of 15 nm were mixed to obtain [Toner a].

Manufacturing of Carrier 100 parts of silicone resin (organo straight silicone), 5 parts of γ-(2-aminoethyl)aminopropyl trimethoxy silane, and 10 parts of carbon black were added to 100 parts of toluene followed by dispersion for 20 minutes by a HOMOMIXER to prepare a resin layer liquid application. Using a fluid bed type coating device, the resin layer liquid application was applied to the surface of 1,000 parts of spherical magnetite having a volume average particle diameter of 50 μm to manufacture toner carrier.

Manufacturing of Development Agent 5 parts of [Toner a] and 95 parts of the carrier were mixed by a ball mill to manufacture a development agent.

Next, the thus-obtained development agent was evaluated as follows with regard to the following properties: The results are shown in Tables 3 and 4.

Low Temperature Fixability

Sheets (TYPE 6200 paper, manufactured by Ricoh Co., Ltd.) were set in a machine having a remodeled fixing device based on a photocopier (MF-200, manufactured by Ricoh Co., Ltd.) having a TEFLON™ roller in the fixing device and a photocopying test was conducted with the machine while changing the temperature of the fixing roller with a temperature gap of 5° C. The lowest temperature among the fixing roller temperatures at which the remaining ratio of a fixed image was 70% or more after the fixed image was rubbed by a pad was defined as the lowest fixing temperature.

Since a lower lowest fixing temperature is preferable in terms of power consumption and a lowest fixing temperature that is 130° C. or higher tends to cause a problem, a lowest fixing temperature of 130° C. or higher was evaluated as bad.

Evaluation Criteria

Evaluation Criteria of Highest Fixing Temperature

E (Excellent): the upper limit of the fixing temperature is 190° C. or higher

G (Good): the upper limit of the fixing temperature is from 180° C. to lower than 190° C.

G (Good): the upper limit of the fixing temperature is from 170° C. to lower than 180° C.

B (Bad): the upper limit of the fixing temperature is lower than 170° C.

Evaluation Criteria of Lowest Fixing Temperature

E (Excellent): the lower limit of the fixing temperature is lower than 110° C.

G (Good): the lower limit of the fixing temperature is from 110° C. to lower than 120° C.

B (Bad): the lower limit of the fixing temperature is from 120° C. to lower than 130° C.

B (Bad): the lower limit of the fixing temperature is 130° C. or higher

High Temperature Stability

A glass container was filled with the toner and left in a constant temperature tank at 50° C. for 24 hours. Subsequent to cooling-down to 24° C., the needle penetration level of the toner was measured by a needle penetration test (according to JIS K2235-1991) to evaluate the high temperature stability by the following criteria: A large needle penetration value indicates excellent high temperature stability. Toner having a needle penetration level less than 5 mm was likely to cause a problem.

Evaluation Criteria

G (Good): 15 mm to less than 25 mm

F (Fair): 5 mm to less than 25 mm

B (Bad): less than 5 mm

Example 2

Toner b of Example 2 was manufactured in the same manner as in Example 1 except that the second resin 2-A was changed to the second resin 2-B in the preparation of the oil phase.

Example 3

Toner c of Example 2 was manufactured in the same manner as in Example 1 except that the second resin 2-A wash changed to the second resin 2-C in the preparation of the oil phase.

Example 4

Toner d of Example 4 was manufactured in the same manner as in Example 1 except that no crystalline polyester liquid dispersion was added.

Example 5

Toner e of Example 5 was manufactured in the same manner as in Example 1 except that the crystalline polyester was changed to N-stearyl oleate amide (NICKAMIDE SO, melting point: 67° C., manufactured by Nippon Kasei Chemical Co., Ltd.).

Example 6

Toner f of Example 6 was manufactured in the same manner as in Example 1 except that the first binder resin was changed from VYLOECOL® BE-410 (manufactured by Tosoh Corporation) to the first binder resin 1-B, the addition amount was changed to 100 parts, and no crystalline polyester liquid dispersion or the second binder resin 2-A was added in the preparation of the oil phase.

Example 7

Toner g of Example 7 was manufactured in the same manner as in Example 1 except that the first binder resin was changed from VYLOECOL® BE-410 (manufactured by Tosoh Corporation) to the first binder resin 1-B, the addition amount was changed to 100 parts, and no second binder resin 2-A was added in the preparation of the oil phase.

Example 8

Toner h of Example 8 was manufactured in the same manner as in Example 2 except that the first binder resin was changed from VYLOECOL® BE-410 (manufactured by Tosoh Corporation) to the first binder resin 1-B and no crystalline polyester liquid dispersion was added in the preparation of the oil phase.

Example 9

Toner i of Example 9 was manufactured in the same manner as in Example 2 except that the first binder resin was changed from VYLOECOL® BE-410 (manufactured by Tosoh Corporation) to the first binder resin 1-B in the preparation of the oil phase.

Comparative Example 1

Toner j of Comparative Example 1 was manufactured in the same manner as in Example 1 except that the second resin 2-A was changed to the second resin 2-D in the preparation of the oil phase.

Comparative Example 2

Toner k of Comparative Example 2 was manufactured in the same manner as in Example 1 except that the second resin 2-A was changed to the second resin 2-E in the preparation of the oil phase.

Comparative Example 3

Toner l of Comparative Example 3 was manufactured in the same manner as in Example 1 except that the second resin 2-A was changed to the second resin 2-F in the preparation of the oil phase.

Comparative Example 4

Toner m of Comparative Example 4 was manufactured in the same manner as in Example 1 except that the first resin 1-A (VYLOECOL® BE-410, manufactured by Tosoh Corporation) was changed to polystyrene in the preparation of the master batch and the oil phase.

Comparative Example 5

Toner n of Comparative Example 5 was manufactured in the same manner as in Example 1 except that the first binder resin (VYLOECOL® BE-410, manufactured by Tosoh Corporation) was changed to the binder resin A in the preparation of the master batch and the toner material phase.

Comparative Example 6

Toner o of Comparative Example 6 was manufactured in the same manner as in Example 1 except that the addition amount of the first binder resin (VYLOECOL® BE-410, manufactured by Tosoh Corporation) was changed to 100 parts and no crystalline polyester liquid dispersion or the second binder resin 2-A was added in the preparation of the oil phase.

Comparative Example 7

Toner p of Comparative Example 7 was manufactured in the same manner as in Example 1 except that the addition amount of the first binder resin (VYLOECOL®BE-410, manufactured by Tosoh Corporation) was changed to 100 parts and no second binder resin 2-A was added in the preparation of the oil phase.

In addition, the toners b to p were evaluated in the same manner as in Example 1. The evaluation results are shown in Tables 3 and 4.

TABLE 3

| | | Second binder resin | | | Fixing |
|---|---|---|---|---|---|
| | Toner | kind | Melting point (° C.) | First binder resin | helping agent |
| Example 1 | a | 2-A | 50.5 | VYLOECOL ® BE-410 | Crystalline polyester |
| Example 2 | b | 2-B | 61.2 | VYLOECOL ® BE-410 | Crystalline polyester |
| Example 3 | c | 2-C | 72 | VYLOECOL ® BE-410 | Crystalline polyester |
| Example 4 | d | 2-A | 50.5 | VYLOECOL ® BE-410 | None |
| Example 5 | e | 2-B | 61.2 | VYLOECOL ® BE-410 | Aliphatic acid amide |
| Example 6 | f | None | — | 1-B | None |
| Example 7 | g | None | — | 1-B | Crystalline polyester |
| Example 8 | h | 2-B | 61.2 | 1-B | None |
| Example 9 | i | 2-B | 61.2 | 1-B | Crystalline polyester |
| Comparative Example 1 | j | 2-D | No melting point | VYLOECOL ® BE-410 | Crystalline polyester |
| Comparative Example 2 | k | 2-E | 45 | VYLOECOL ® BE-410 | Crystalline polyester |
| Comparative Example 3 | l | 2-F | 88.5 | VYLOECOL ® BE-410 | Crystalline polyester |
| Comparative Example 4 | m | 2-A | 50.5 | Polystyrene | Crystalline polyester |
| Comparative Example 5 | n | 2-A | 50.5 | None | Crystalline polyester |
| Comparative Example 6 | o | None | — | VYLOECOL ® BE-410 | None |
| Comparative Example 7 | p | None | — | VYLOECOL ® BE-410 | Crystalline polyester |

TABLE 4

| | Toner | T½ (° C.) | Mw | Dv | Dv/Dn | Lower limit of fixing | Upper limit of fixing | High temperature stability |
|---|---|---|---|---|---|---|---|---|
| Example 1 | a | 83 | 23,000 | 5.1 | 1.14 | E | G | G |
| Example 2 | b | 98 | 26,000 | 5.4 | 1.13 | E | E | E |
| Example 3 | c | 110 | 27,000 | 5.3 | 1.15 | G | E | E |
| Example 4 | d | 117 | 23,800 | 5 | 1.12 | F | E | E |
| Example 5 | e | 104 | 21,000 | 5.6 | 1.32 | G | G | F |
| Example 6 | f | 114 | 11,500 | 5.6 | 1.14 | F | F | G |
| Example 7 | g | 110 | 11,000 | 5.7 | 1.13 | F | F | F |
| Example 8 | h | 107 | 12,000 | 5.4 | 1.13 | G | F | F |
| Example 9 | i | 100 | 11,000 | 5.5 | 1.15 | E | F | F |
| Comparative Example 1 | j | 72 | 27,000 | 5.4 | 1.14 | G | E | B |
| Comparative Example 2 | k | 77 | 18,000 | 5.4 | 1.14 | G | B | F |
| Comparative Example 3 | l | 124 | 29,000 | 5.3 | 1.15 | B | E | E |
| Comparative Example 4 | m | 130 | 30,000 | 6.2 | 1.34 | B | G | B |
| Comparative Example 5 | n | 75 | 8,500 | 5.6 | 1.14 | E | F | B |
| Comparative Example 6 | o | 130 | 27,000 | 5.4 | 1.15 | B | E | E |
| Comparative Example 7 | p | 124 | 24,000 | 5.5 | 1.15 | B | G | G |

As seen in the results shown in Tables 3 and 4, the toners obtained in Examples 1 to 5 are excellent with regard to both of the fixability and the high temperature stability. In particular, the melting point of the second binder resin of Example 2 was within the preferable range and it was confirmed that the most excellent results were obtained to strike a balance between the fixability and the high temperature stability.

In Examples 6 to 9, the weight average molecular weight of the THF soluble portion was small so that the upper limit of the fixing and the high temperature stability were inferior to those of Examples 1 to 5.

In Comparative Example 1, the second binder resin has no melting point and was liquid at room temperature, so that the high temperature stability was inferior. In Comparative Example 2, since the melting point of the second binder resin was too low, the viscoelasticity of the toner lowered excessively so that the upper limit of the fixing was not sufficient.

In Comparative Example 3, in contrast of Comparative Example 2, the melting point of the second binder resin was too high. As a consequence, the low temperature fixability was insufficient.

In Comparative Example 5, since no first binder resin was contained, the viscoelasticity of the toner lowered excessively, which leaded to deterioration of the high temperature stability.

In Comparative Examples 6 and 7, the half effusion temperatures were high, so that the low temperature fixability was inferior.

As described above, in the present invention, there are provided toner derived from plant materials to strike a balance between the low temperature fixability and the high temperature stability, carrier using the toner, and an image forming method using the toner.

Having now fully described embodiments of the present invention, it will be apparent to one of ordinary skill in the art that many changes and modifications can be made thereto without departing from the spirit and scope of embodiments of the invention as set forth herein.

What is claimed is:

1. A toner comprising:

a binder resin; and a colorant, wherein the binder resin comprises a first binder resin which is a non-crystalline resin having a polyhydroxy carboxylic acid skeleton in a main chain and a second binder resin which is a copolymer comprising a non-crystalline resin unit and a crystalline resin unit, and wherein the toner has a half effusion temperature of from 80° C. to 120° C. as measured by a temperature rising method using a flow tester.

2. The toner according to claim 1, wherein the second binder resin has a melting point of from 50° C. to 80° C. and the non-crystalline resin unit has a polyhydroxy carboxylic acid skeleton in a main chain thereof.

3. The toner according to claim 2, wherein the first binder resin is a biodegradable resin that comprises repeating units of polycondensed lactic acid.

4. The toner according to claim 1, wherein the non-crystalline resin unit in the second binder resin consists of the first binder resin.

5. The toner according to claim 4, wherein the first binder resin is a biodegradable resin that comprises repeating units of polycondensed lactic acid.

6. The toner according to claim 1, wherein the crystalline resin unit in the second binder resin is a crystalline polyester.

7. The toner according to claim 6, wherein the first binder resin is a biodegradable resin that comprises repeating units of polycondensed lactic acid.

8. The toner according to claim 1, further comprising a fixing helping agent.

9. The toner according to claim 8, wherein the fixing helping agent comprises a crystalline polyester resin having a melting point of from 15° C. lower than a melting point of the second binder resin to 15° C. higher than said melting point of the second binder resin.

10. The toner according to claim 1, wherein a weight average molecular weight of a tetrahydrofuran soluble portion of the toner ranges from 20,000 to 50,000 as measured by a gel permeation chromatography.

11. The toner according to claim 1, wherein the crystalline resin unit ranges from 20% by weight to 80% by weight in the second resin.

12. The toner according to claim 1, wherein the first binder resin is a biodegradable resin that comprises repeating units of polycondensed lactic acid.

13. A development agent comprising:

toner carrier; and the toner of claim 1.

* * * * *